US008490611B2

(12) United States Patent
Maynard

(10) Patent No.: US 8,490,611 B2
(45) Date of Patent: Jul. 23, 2013

(54) DISTANCE COMPENSATION SIGHT DEVICE FOR AIMING AN ARCHERY BOW

(76) Inventor: Bobby Maynard, Burnet, TX (US)

( * ) Notice: Subject to any disclaimer, the term of this patent is extended or adjusted under 35 U.S.C. 154(b) by 399 days.

(21) Appl. No.: 12/775,750

(22) Filed: May 7, 2010

(65) Prior Publication Data

US 2011/0271943 A1 Nov. 10, 2011

(51) Int. Cl.
*F41G 1/467* (2006.01)

(52) U.S. Cl.
USPC ..... 124/87; 33/265

(58) Field of Classification Search
USPC ..... 33/265, 377; 124/86, 87, 88
See application file for complete search history.

(56) References Cited

U.S. PATENT DOCUMENTS 601,629 A * 4/1898 Castor ..... 33/291
652,078 A * 6/1900 Cable ..... 33/377
936,407 A * 10/1909 Bunting ..... 33/377
1,012,993 A * 12/1911 Dissett ..... 33/377
1,305,935 A * 6/1919 Rieker ..... 33/370
4,567,668 A * 2/1986 King et al. ..... 33/265
4,785,541 A 11/1988 Lowry
5,220,907 A 6/1993 Lonsdale
5,303,479 A * 4/1994 Rudovsky ..... 33/265
5,339,227 A * 8/1994 Jones ..... 362/109
5,442,862 A 8/1995 Newbold et al.
5,507,272 A 4/1996 Scantlen
5,539,989 A 7/1996 Potter
5,561,910 A 10/1996 Maynard
5,630,279 A * 5/1997 Slates ..... 33/265
5,941,226 A 8/1999 Marietta
6,401,347 B1 6/2002 Slates
6,477,779 B1 11/2002 Slates
6,564,462 B1 5/2003 Henry
6,609,306 B2 8/2003 Johnson et al.
6,701,632 B2 * 3/2004 Henry ..... 33/265
6,842,989 B1 1/2005 Wuthrich

* cited by examiner

*Primary Examiner* — John Ricci
(74) *Attorney, Agent, or Firm* — Meyertons, Hood, Kivlin, Kowert & Goetzel, P.C.; Eric B. Meyertons

(57) ABSTRACT

A sight device for aiming an archery bow includes a body, and a fluid conduit assembly coupled to the body and containing a liquid, the level of the liquid in at least a portion of the fluid conduit assembly providing a sight indication for the archery bow.

45 Claims, 5 Drawing Sheets

DISTANCE COMPENSATION SIGHT DEVICE FOR AIMING AN ARCHERY BOW

BACKGROUND

1. Field of the Invention

The present invention relates to the field of archery. In particular, embodiments relate to bow sight devices providing automatic distance compensation.

2. Description of the Related Art

In recent years, archery, the art or sport of shooting with an archery bow and arrow at a target, and the related sport of bow hunting have seen a continued increase in popularity. As such, the demand for archery and bow hunting equipment has also increased. In response to the increase in demand, the archery industry has become more technologically advanced. Modern compound archery bows propel arrows at speeds of over 300 feet per second. Still, the effect of gravity on the discharged arrow remains constant. It is well known that the slower the speed of a projectile, the more it will drop over the course of its flight. To compensate for this drop, a projectile must be fired above the line of sight to the target in an arched path to successfully strike the intended target. In order to assist archers in approximating the arched trajectory of an arrow while taking aim at a target, many archery bows are equipped with sighting systems. The following references disclose typical sighting systems and are incorporated by reference herein: U.S. Pat. No. 5,507,272 to Scantlen, U.S. Pat. No. 6,842,989 to Wuthrich, U.S. Pat. No. 6,564,462 to Henry, U.S. Pat. No. 6,609,306 to Johnson et al., U.S. Pat. No. 5,941,226 to Marietta, U.S. Pat. No. 6,401,347 to Slates, U.S. Pat. No. 6,477,779 to Slates, U.S. Pat. No. 5,561,910 to Maynard, and U.S. Pat. No. 5,442,862 to Newbold et al.

Many sighting systems include a peep sight tied into the bow string of an archery bow and at least one sight pin corresponding to a specific target distance for the shot. To aim, the archer will look through the peep sight at full draw and align the target with the appropriate sight pin. These pin sighting systems require the archer to know or estimate the distance to the target. Thus, even the shot of a skilled archer using a pin sight is only as accurate as the estimated distance to the target.

In an effort to remedy the distance estimation problem, some archery bows are further equipped with a range finder to accurately determine the line of sight distance to a target. In some states, however, it is illegal to have a range finder mounted to an archery bow while bow hunting. As such, the distance to the target cannot be determined while the archer is aiming at the target and the bow string is fully drawn. In any event, even if the distance to the target is known, a problem arises when the sight pin system does not have an appropriate pin for the required distance. In this situation, the archer must shoot between pins and sacrifice at least some level of accuracy.

In view of these and other concerns, it appears that there is a need for a bow sight device for archery bows that provides distance compensation automatically, and irrespective of the actual distance to the target, when aiming.

SUMMARY

A sight device for aiming an archery bow includes a body, and a fluid conduit assembly coupled to the body and containing a liquid, the level of the liquid in at least a portion of the fluid conduit assembly providing a sight indication for an archery bow. In some embodiments, a fluid conduit assembly includes at least one supply conduit and at least one sight conduit in fluid communication with at least one supply conduit. In some embodiments, the fluid conduit assembly contains a selected amount of the liquid. In certain embodiments, the sight conduit is positioned such that, when the sight device is attached to an archery bow, and the archery bow is held at a substantially level position, the liquid is at a first level in the fluid conduit assembly. In certain embodiments, at least one supply conduit is positioned with respect to at least one sight conduit such that, when the body is angled downward from the substantially level position, liquid flows from the supply conduit to the sight conduit, and when the body is angled upward from the substantially level position, liquid flows from the sight conduit to the supply conduit. In some embodiments, the level of the liquid is visible in at least a portion of the fluid conduit assembly.

In some embodiments, at least a portion of the supply conduit is positioned at an oblique angle of about 15° to 30° with respect to a longitudinal axis of the sight conduit.

In some embodiments, the aggregate area of one or more supply conduits is about 0.5 to 5 times the aggregate area of one or more sight conduits.

In certain embodiments, the volume of the selected amount of liquid is about 30% to 70% of the volume of the fluid conduit assembly.

In further embodiments, additional features may be added to the specific embodiments described herein.

BRIEF DESCRIPTION OF THE DRAWINGS

The present invention will be better understood and other advantages will appear on reading the detailed description of some embodiments taken as non-limiting examples and illustrated by the following drawings in which.

Figure 1A:
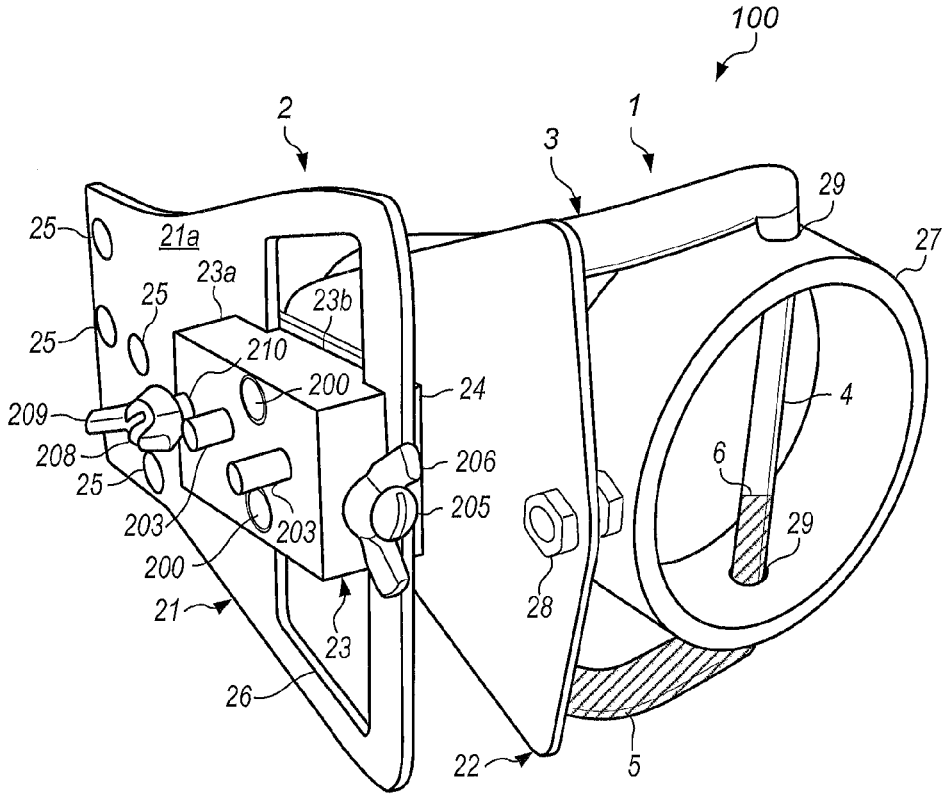
FIG. 1A is a perspective view of an embodiment of a bow sight device.

While the invention is susceptible to various modifications and alternative forms, specific embodiments thereof are shown by way of example in the drawings and will herein be described in detail. It should be understood, however, that the drawing and detailed description thereto are not intended to limit the invention to the particular form disclosed, but on the contrary, the intention is to cover all modifications, equivalents and alternatives falling within the spirit and scope of the present invention as defined by the appended claims. Furthermore, the word "may" is used throughout this application in a permissive sense (i.e., having the potential to, being able to), not a mandatory sense (i.e., must). The term "include", and derivations thereof, mean "including, but not limited to". The term "coupled" means directly or indirectly coupled.

DETAILED DESCRIPTION OF ILLUSTRATIVE EMBODIMENTS

In the context of this application, the following terms are defined as:

A "fluid" may be, but is not limited to, a gas, a liquid, an emulsion, a slurry, and/or a stream of solid particles that has flow characteristics similar to liquid flow.

A "conduit" refers to a pipe, tube, or the like, for conveying fluid. A conduit may be made of any suitable material (e.g., metal, metal alloy, and/or polymer). A conduit may be provided with any suitable length, thickness, or angulation.

"Coupled" means either a direct connection or an indirect connection (e.g., one or more intervening connections) between one or more objects or components. The phrase "directly connected" means a direct connection between objects or components such that the objects or components are connected directly to each other so that the objects or components operate in a "point of use" manner.

A "supply conduit" refers to a constituent member of a fluid conduit assembly operable to convey liquid to and from at least one sight conduit.

A "sight conduit" refers to a constituent member of a fluid conduit assembly operable to convey liquid to and from at least one supply conduit while providing a sight indication for an archery bow.

A "fluid conduit assembly" refers to two or more coupled supply and/or sight conduits in fluid communication.

The "thickness" of a member refers to the thickness of a cross section of the member, wherein the cross section is normal to a face of the member A "sight picture" refers to the view of an archer just before the arrow is discharged from the archery bow. Most sight pictures include the target and at least some portion of the archery bow. It is well known that successive shots taken with a substantially identical sight picture will fall approximately on the same point.

A "peep sight", also known as a string peep, refers to a small round piece of plastic or metal which is set between the strands of a bow string for sighting through when aiming an archery bow. A peep sight is often aligned with a bow sighting device and vertically located where the eye of the archer naturally rests at full draw.

A "bow angle" describes the vertical angulation of an archery bow with respect to a substantially level position. The bow angle may be defined as the angle of an arrow with respect to level ground when the arrow is fitted to the bow.

The "range" of an arrow refers to the actual, estimated, or predicted horizontal distance traveled by the arrow when fired at a certain elevation, bow angle, and speed.

A "body" refers to any physical structure capable of at least partially supporting another element. A body may have various regular or irregular shapes. For example, portions of a body may be straight, curved, or a combination of both.

"Canting" refers to holding an archery bow to the right or left while at full draw. The reference to right or left is determined by the position of the top limb.

"Area" refers to a two-dimensional quantitative measure of the space enclosed or occupied by an element. For example, the area of a conduit may refer to a quantitative measure of the interior cross-sectional area measured through a diameter of a cylindrical conduit.

"Volume" refers to a three-dimensional quantitative measure of the space enclosed or occupied by an element. The volume of a conduit refers to a quantitative measure of the interior space enclosed by the conduit.

A "mechanical fastener" refers to a fastener that is used to couple two or more elements together by force. Examples of a mechanical fastener include, but are not limited to, a bolt or a screw.

Figure 1B:
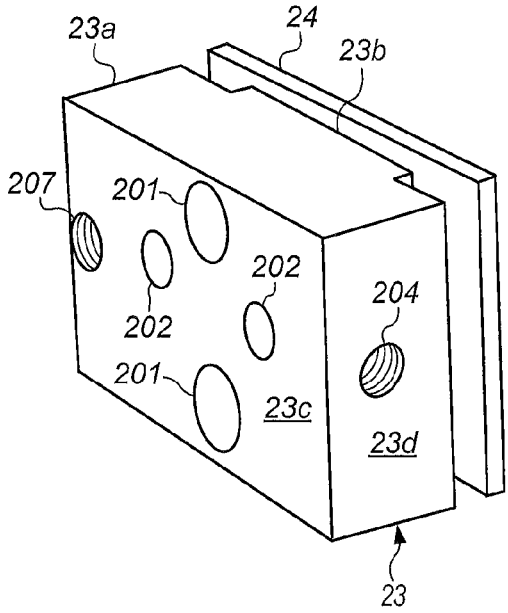
FIG. 1B is a detailed view of the adjustment block and the adjustment plate in FIG. 1A.
Figure 2:
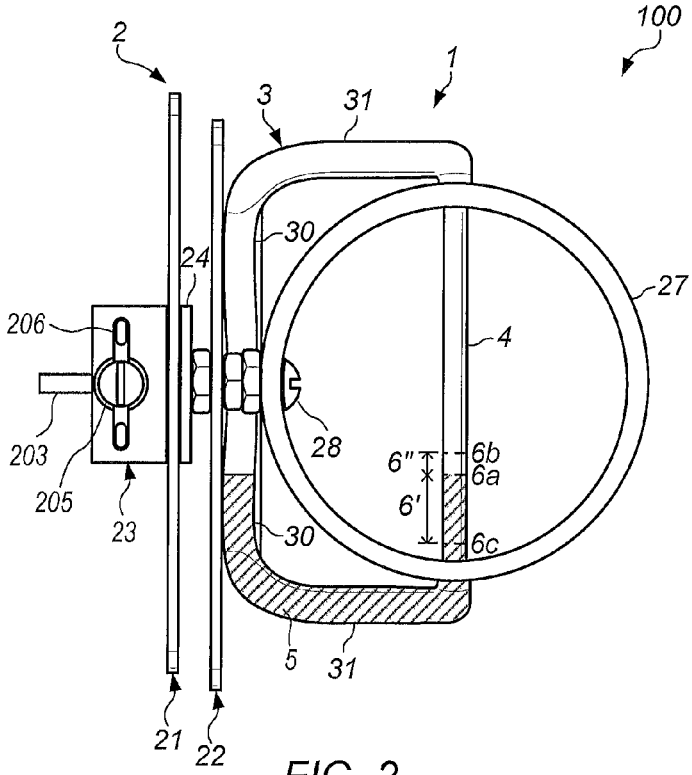
FIG. 2 is a front view of the embodiment of a bow sight device shown in FIG. 1A.
Figure 3:
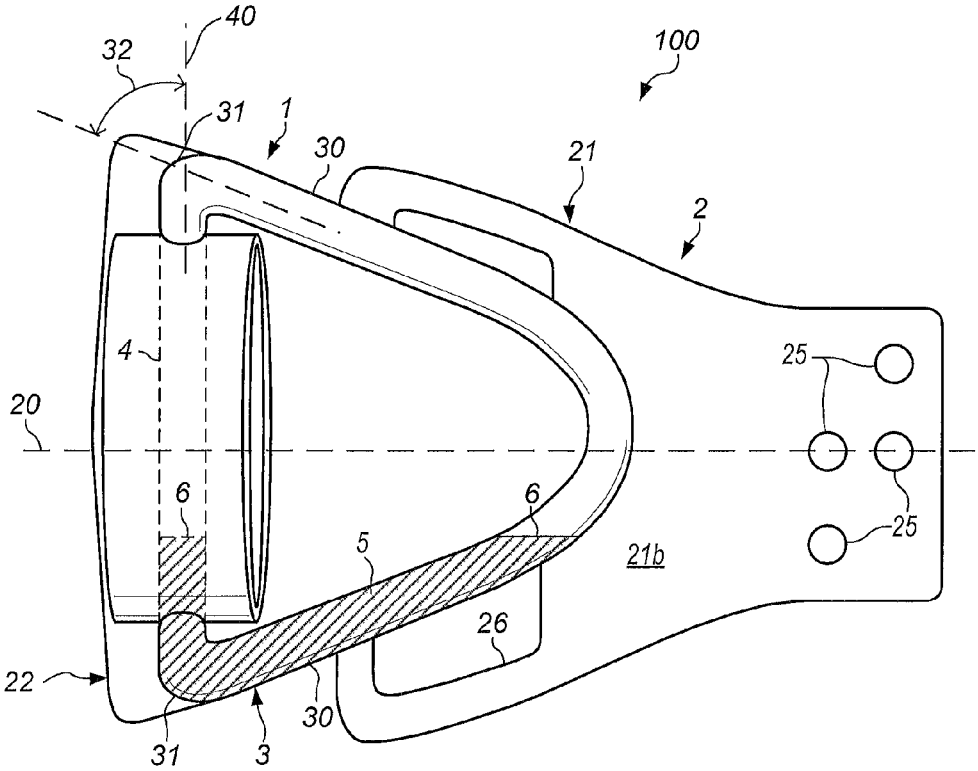
FIG. 3 is a side view of the embodiment of a bow sight device shown in FIG. 1A.

FIGS. 1-3 illustrate an embodiment of a bow sight device. Bow sight device 100 includes fluid conduit assembly 1 coupled to body 2. In some embodiments, body 2 is attachable to an archery bow. Fluid conduit assembly 1 includes supply conduit 3 in fluid communication with sight conduit 4 such that liquid 5 contained therein rests at level 6. A fluid conduit assembly may be produced of any suitable material. In some embodiments, the fluid conduit assembly is produced of one or more polymeric materials. Examples of suitable polymeric materials include, but are not limited to: polypropylene, polystyrene, polycarbonate, polyethylene terephthalate, polyamides, polyvinyl chloride, polyurethanes, polyvinylidene chloride, polyethylene, polytetrafluoroethylene, polyetherimide, and polymethyl methacrylate.

In some embodiments, at least a portion of the fluid conduit assembly is formed from a transparent polymeric material or a transparent glass (e.g., borosilicate glass, quartz glass, etc.). In an embodiment, at least the sight conduit is formed from a transparent polymeric material.

In some embodiments, the fluid conduit assembly is configured such that the liquid contained therein rests at a position of equilibrium based on the distribution of pressure in the fluid conduit assembly. In certain embodiments, the pressure in the fluid conduit assembly is distributed substantially uniformly. That is, the fluid conduit assembly is virtually void of a net pressure difference. As such, the level of the liquid in the sight conduit is in the same independent horizontal plane as the level of the liquid in the supply conduit. In one embodiment, the fluid conduit assembly is maintained at substantially atmospheric pressure.

According to the depicted embodiment, sight conduit 4, is tubular and positioned substantially vertically. A sight conduit, however, may be positioned in any suitable arrangement or orientation. In some embodiments, the diameter of sight conduit 4 is about 3/16 of an inch (approximately 0.1875 in. or 4.76 mm.). A sight conduit, however, may be produced of any suitable size or shape. In some embodiments, when the bow sight device is coupled to the frame of an archery bow, a sight conduit is positioned substantially parallel to the bow string of the archery bow. It may be advantageous to position a sight conduit as such so that when the archery bow is aimed during use, a sight picture where the target is vertically aligned with the level of the liquid in the sight conduit may be formed (see FIG. 6).

Figure 4A:
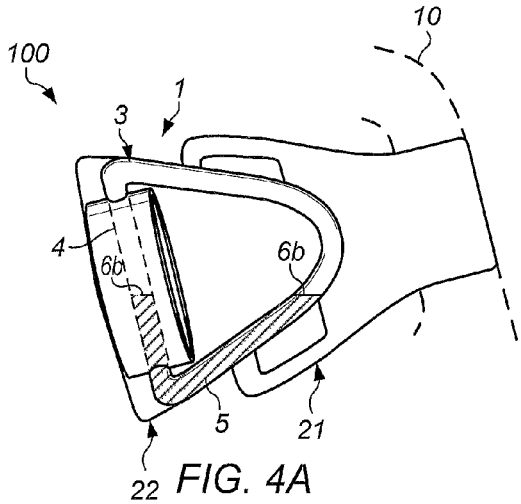
FIGS. 4A-4C are detailed side views of the embodiment of a bow sight device shown in FIG. 1A coupled to a compound bow at various degrees of vertical angulation.
Figure 4D:
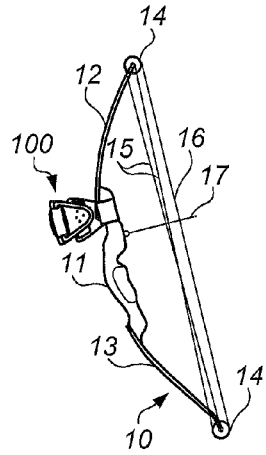
FIGS. 4D-4F are full side views of the embodiment of a bow sight device shown in FIG. 1A coupled to a compound bow at various degrees of vertical angulation.
Figure 4B:
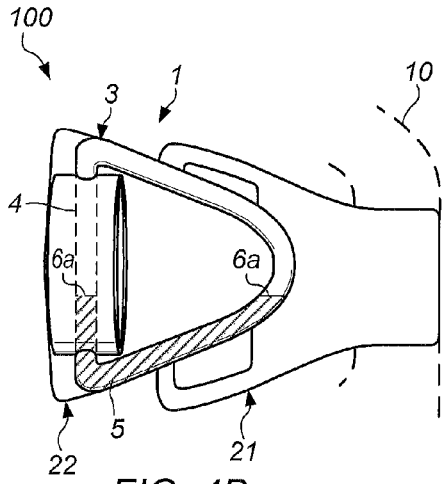
Figure 4E:
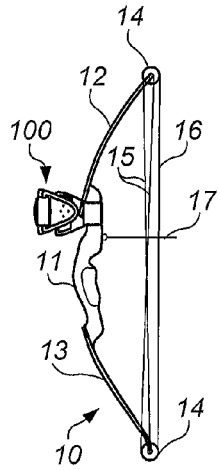
Figure 4C:
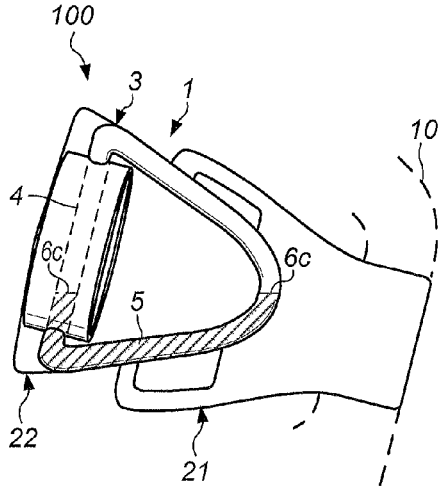
Figure 4F:
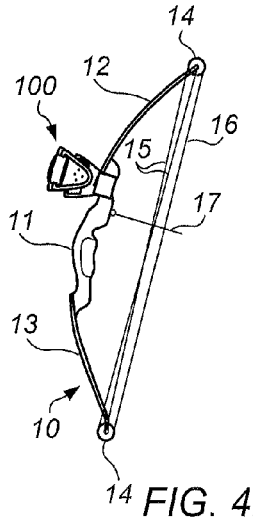

In some embodiments, the level of the liquid in the fluid conduit assembly varies with respect to the degree of vertical angulation. For example, FIGS. 4A-4C depict bow sight device 100 coupled to the frame of compound archery bow 10 (for clarity, only a portion of compound archery bow 10 is shown) at various degrees of vertical angulation. FIGS. 4D-4F depict compound archery bow 10 in its entirety. Compound archery bow 10 includes shaft 11 coupled to top limb 12 and bottom limb 13. Compound archery bow 10 further includes rotating wheels 14 coupled to the distal ends of top limb 12 and bottom limb 13 respectively. In some embodiments, at least one of rotating wheels 14 is a cam. Cables 15 and bow string 16 are coupled to rotating wheels 14. Bow sight device 100 and cable guard 17 are coupled to shaft 11. FIG. 4B depicts compound archery bow 10 and bow sight device 100 at a substantially level position. Liquid 5, contained within fluid conduit assembly 1, rests at level 6*a*. When compound archery bow 10 and bow sight device 100 are angled downward (see FIG. 4A), liquid 5 flows from supply conduit 3 to sight conduit 4 until an appropriate equilibrium level is reached (i.e., level 6*b*). As a result, the amount of liquid 5 in sight conduit 4 increases. Similarly, when compound archery bow 10 and bow sight device 100 are angled upward (see FIG. 4C), liquid 5 flows from sight conduit 4 to supply conduit 3 until an appropriate equilibrium level is reached (i.e., level 6*c*). As a result, the amount of liquid 5 in sight conduit 4 decreases. In some embodiments, the level of the liquid in at least a portion of the fluid conduit assembly provides a sight indication for an archery bow. In certain embodiments, the level of the liquid in the sight conduit is visible and provides a sight indication for an archery bow.

Turning back to FIGS. 1-3, according to the depicted embodiment, supply conduit 3 is tubular and positioned symmetrically with respect to horizontal axis 20. In some embodiments, the diameter of supply conduit 3 is about 5/16 of an inch (approximately 0.3125 in. or 7.93 mm.). A supply conduit, however, may be produced of any suitable size or shape. Supply conduit 3 includes gravity biased portions 30 and connector portions 31. Gravity biased portions 30 are positioned at oblique angle 32 with respect to longitudinal axis 40 of sight conduit 4, such that when bow sight device 100 is coupled to compound archery bow 10 and the archery bow is angled upward, the decrease 6' of the amount of liquid 5 in sight conduit 4, per degree of angulation, is greater than the increase 6" of the amount of liquid 5 in sight conduit 4, per degree of angulation, when compound archery bow 10 is angled downward (See FIG. 2). Similarly, for a range of bow angles, the increase of the range of an arrow shot by an archery bow, per degree of angulation, as the archery bow is angled upward is greater than the decrease of the range of the arrow shot by the archery bow, per degree of angulation, as the archery bow is angled downward. Therefore, it may be advantageous to configure the fluid conduit assembly as described above in order to reflect the change in the range of the arrow, per degree of angulation, for a range of bow angles.

In certain embodiments, the fluid conduit assembly is configured such that the effect of gravity on the level of the liquid in at least a portion of the fluid conduit assembly is proportional to the effect of gravity on the trajectory of an arrow shot from an archery bow for a range of bow angles. In some embodiments, gravity biased portions 30 are positioned at an angle of about 1° to 90° with respect to a longitudinal axis of sight conduit 4. In various embodiments, gravity biased portions are positioned at an oblique angle of about 10° to 70° with respect to a longitudinal axis of sight conduit 4. In certain embodiments, gravity biased portions are positioned at an oblique angle of about 15° to 30°, 20° to 26°, or 21° to 24° with respect to a longitudinal axis of sight conduit 4. In one embodiment, gravity biased portions are positioned at an oblique angle of about 23° with respect to a longitudinal axis of sight conduit 4.

Connector portions 31 of supply conduit 3 are substantially horizontal. Connector portions 31 link gravity biased portions 30 with sight conduit 4, thereby forming a closed loop conduit assembly. Thus, the operability of bow sight device 100 is retained when the orientation of the bow sight device is rotated by 180° about horizontal axis 20. Some archery bows are configured to "shoot left or right handed". That is, such archery bows are operable by both left and right hand dominant archers. Such archery bows, when equipped with sighting systems, are often rotated 180° about a horizontal axis in order to adapt the archery bow for left and right hand dominant archers respectively. As such, it may be advantageous to configure the fluid conduit assembly such that operability of the bow sight device is retained when the orientation of the bow sight device is rotated by 180° about a horizontal axis so that the bow sight device will be operable when attached to archery bows that shoot left or right handed. In some embodiments, the fluid conduit assembly is integrally formed as a single piece. It may be advantageous to form the fluid conduit assembly as such in order to substantially inhibit leaking and/or evaporation of the liquid contained therein.

In some embodiments, the aggregate area of one or more supply conduits and the aggregate area of any sight conduits in fluid communication with the supply conduits are provided at a selected ratio. In some embodiments, the selected ratio is predetermined. In general, as the ratio increases (i.e., as the aggregate area of the sight conduits grows larger compared to the aggregate area of the supply conduits), the bow sight device becomes relatively less sensitive to vertical angulation. That is, the change in the amount of the liquid in the sight conduits, per degree of angulation, (e.g., 6' and 6") decreases. Conversely, as the ratio increases (i.e., as the aggregate area of the sight conduits grows smaller compared to the aggregate area of the supply conduits), the bow sight device becomes relatively more sensitive to vertical angulation. That is, the change in the amount of the liquid in the sight conduits, per degree of angulation, (e.g., 6' and 6") increases. It may be advantageous to configure the fluid conduit assembly such that the aggregate areas of the supply conduits and sight conduits are provided at a selected ratio in order to configure the device at optimal sensitivity to vertical angulation. In some embodiments, the selected ratio is about 0.5 to 20. That is, the supply conduits are provided with an aggregate area approximately 0.5 to 20 times the aggregate area of the sight conduits. In various embodiments, the selected ratio is about 0.5 to 10. In certain embodiments, the selected ratio is about 0.5 to 5. In one embodiment, the selected ratio is about 1.4.

According to the depicted embodiment, fluid conduit assembly 1 contains a selected amount of liquid 5. In some embodiments the selected amount of liquid is predetermined. In general, as the volume of the liquid increases with respect to the volume of the fluid conduit assembly, the bow sight device becomes relatively more sensitive to vertical angulation. Conversely, as the volume of the liquid decreases with respect to the volume of the fluid conduit assembly, the bow sight device becomes relatively less sensitive to vertical angulation. Increasing the volume of the liquid with respect to the volume of the fluid conduit assembly may also affect the range of bow angles for which the bow sight device is operable. Increasing the volume of the liquid may increase the base liquid level of the fluid when the bow sight device is at a substantially level position (e.g., level 6*a*). As such, the available volume of the sight conduit to which the liquid may flow when the bow sight device is angled downward is decreased. Similarly, the available volume of the supply conduit to which the liquid may flow when the bow sight device is angled upward is decreased. As a result, the range of bow angles for which the bow sight device is operable is also decreased. It may be advantageous to provide the fluid conduit assembly with a selected amount of liquid in order to configure the device such that the sensitively to vertical angulation and the range of operability are optimized. In some embodiments, the volume of the liquid is about 5% to 95% of the volume of the fluid conduit assembly. In various embodiments, the volume of the liquid is about 20% to 80% of the volume of the fluid conduit assembly. In certain embodiments, the volume of the liquid is about 30% to 70% of the volume of the fluid conduit assembly. In one embodiment, the volume of the liquid is about 50% of the volume of the fluid conduit assembly.

In some embodiments, the fluid conduit assembly may contain two or more immiscible liquids. In some embodiments, the liquid includes one or more anti-freezing agents (e.g., ethylene, glycol, ethanol, methanol, etc.). In some embodiments, the liquid is colored. It may be advantageous to provide the bow sight device with colored liquid so that the liquid level is easily visible. In some embodiments, the liquid is less viscous than water. It is well known that viscosity is a material property that measures a fluid's resistance to flowing. Viscosity is also commonly thought of as the internal fluid friction, opposing any applied force. As such, it follows that, in the presence of an applied force of equal magnitude, a relatively less viscous liquid will flow more quickly than a relatively more viscous liquid. Thus, it may be advantageous to provide the fluid conduit assembly with a liquid of relatively low viscosity so that the liquid responds more quickly to angulation of the bow sight device. Examples of suitable low viscosity liquids include, but are not limited to: water, ethyl alcohol, acetone, methanol, and benzene.

Figure 5A:
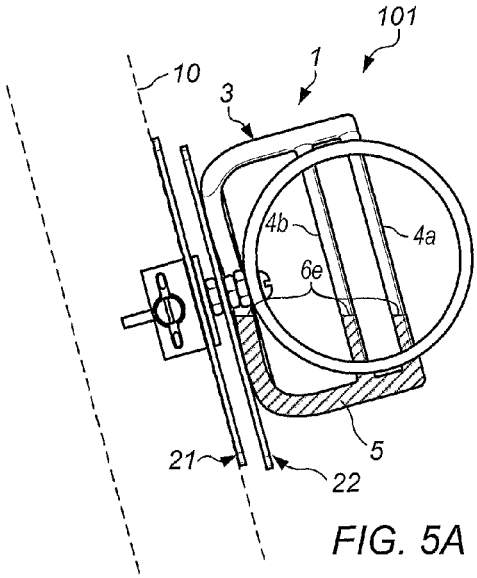
FIGS. 5A-5C are detailed front views of an embodiment of a bow sight device coupled to a compound archery bow at various degrees of horizontal angulation.
Figure 5D:
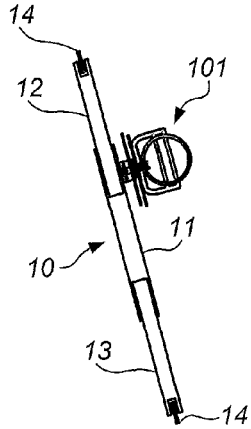
FIGS. 5D-5F are full front views of an embodiment of a bow sight device coupled to a compound archery bow at various degrees of horizontal angulation.
Figure 5B:
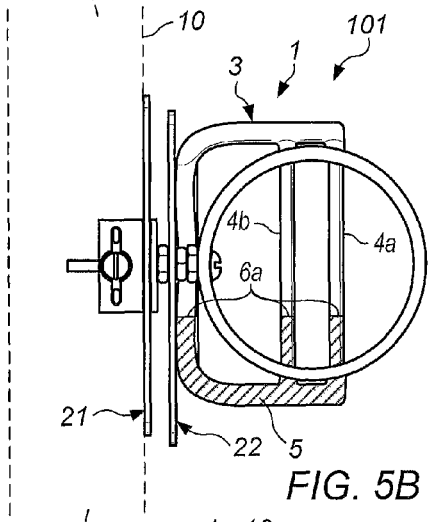
Figure 5E:
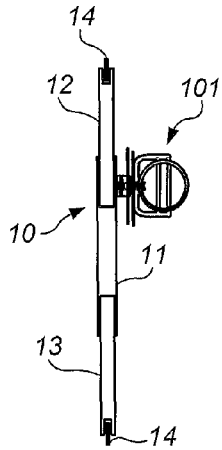
Figure 5C:
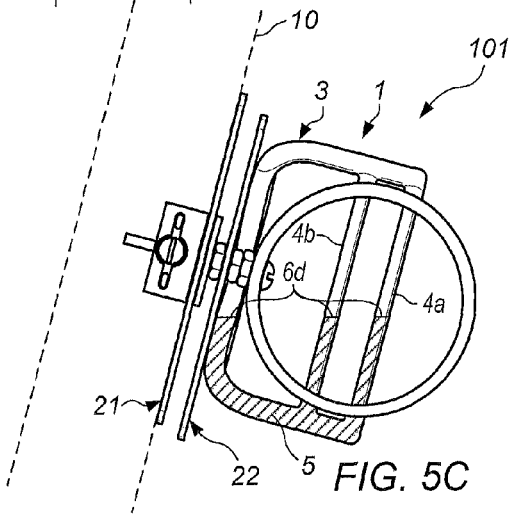
Figure 5F:
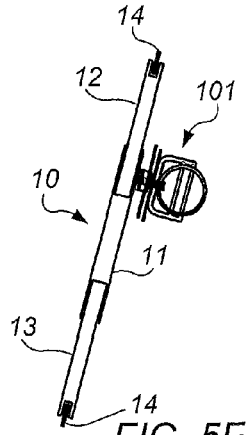

A bow sight device may include any number of sight conduits. In some embodiments, the bow sight device includes a first sight conduit and a second sight conduit in fluid communication with a supply conduit and arranged such that when the bow sight device is coupled to the frame of an archery bow and the archery bow is canted to the left or right, the amount of the liquid in either the first or second sight conduit is greater than the amount of the liquid in the other sight conduit. For example, FIGS. 5A-5C depict bow sight device 101 coupled to the frame of compound archery bow 10 (for clarity, only a portion of compound archery bow 10 is shown) which is canted to the left and right. FIGS. 5D-5F depict compound archery bow 10 in its entirety. Bow sight device 101 includes first sight conduit 4*a* and second sight conduit 4*b*. Further, according to the depicted embodiment, sight conduits 4*a* and 4*b* are approximately equal in length and diameter. FIG. 5B depicts compound archery bow 10 and bow sight device 101 at a substantially level position. Liquid 5, contained within fluid conduit assembly 1, rests at level 6*a*. When compound archery bow 10 is canted to the right (see FIG. 5C), liquid 5 comes to rest at a new position of equilibrium (i.e., level 6*d*) in which the amount of liquid 5 in first sight conduit 4*a* is greater than the amount of liquid 5 in second sight conduit 4*b*. Conversely, when compound archery bow 10 is canted to the left (see FIG. 5A), liquid 5 comes to rest at a new position of equilibrium (i.e., level 6*e*) in which the amount of liquid 5 in second sight conduit 4*b* is greater than the amount of liquid 5 in first sight conduit 4*a*. It may be advantageous to configure the fluid conduit assembly such that the canting of the bow is indicated by at least one sight conduit so that during use, the archer may adjust the orientation and position of the bow or the sight picture accordingly in order to hit a target.

Turning back to FIGS. 1-3, according to the depicted embodiment, body 2 includes mounting bracket 21 coupled to support bracket 22 via adjustment block 23 and adjustment plate 24. In some embodiments, body 2 at least partially supports the fluid conduit assembly. For example, supply conduit 3 is coupled to support bracket 22 of body 2. In certain embodiments, the supply conduit is fixably coupled to the support bracket. A fluid conduit assembly, however, may be coupled to a body by any means.

Mounting bracket 21 includes apertures 25 and slot 26. In some embodiments, body 2 is mountable to the frame of an archery bow. For example, apertures 25 may receive one or more mechanical fasteners positioned therein to couple the mounting bracket to the frame of an archery bow. According to the depicted embodiment, the main section (23*a*) of adjustment block 23 is a rectangular prism. An adjustment block, however, may be of any suitable shape or size. Adjustment block 23 also includes an auxiliary section (23*b*) of similar shape extending from section 23*a*. Section 23*b* is provided with a reduced width and thickness as compared to section 23*a*. The width of section 23*b* is slightly less than that of slot 26, such that section 23*b* may be located movably within slot 26. The thickness of section 23*b* is approximately equal to that of slot 26. Adjustment block 23 is positioned such that section 23*b* is located within slot 26 and at least a portion of section 23*a* abuts at least a portion of face 21*a* of mounting bracket 21.

According to the depicted embodiment, adjustment plate 24 is also a rectangular prism. An adjustment plate, however, may be of any suitable shape or size. Adjustment plate 24 is vertically aligned with adjustment block 23 and positioned such that at least a portion of adjustment plate 24 abuts at least a portion of face 21*b* of mounting bracket 21. Adjustment block 23 includes apertures 201 extending therethrough. Apertures 201 may be positioned in any configuration on adjustment block 23. In some embodiments, apertures 201 may be bored or countersunk. Adjustment plate 24 also includes apertures (not shown) aligned with apertures 201 located on adjustment block 23. Adjustment block 23 is coupled to adjustment plate 24 via rivets 200 disposed within apertures 201, thereby coupling adjustment block 23 and adjustment plate 24 to mounting bracket 21. In some embodiments, the adjustment block and the adjustment plate are movably coupled to the mounting bracket. In certain embodiments, the vertical position of adjustment block 23 and adjustment plate 24 with respect to mounting bracket 21 may be adjusted by sliding adjustment block 23 and adjustment plate 24 together along slot 26.

Adjustment block 23 further includes apertures 202 extending therethrough. Adjustment plate 24 also includes apertures (not shown) aligned with apertures 202 located on adjustment block 23. Adjustment rods 203, coupled to support bracket 22, are movably disposed within apertures 202 of adjustment block 23 and adjustment plate 24 such that the horizontal distance between the support bracket and the mounting bracket may be adjusted by sliding adjustment rods 203 through apertures 202.

Adjustment block 23 further includes threaded aperture 204 positioned on side face 23*d* of adjustment block 23, extending at least partially therethrough and intersecting apertures 202. Threaded aperture 204 is vertically aligned with adjustment rods 203. Bolt 205 including wingnut 206 is accepted by threaded aperture 204. The shaft (not shown) of bolt 205 is provided of a suitable length such that the distal end of the shaft abuts at least a portion of an adjustment rod 203 when the bolt is translated through threaded aperture 204. In some embodiments, bolt 205 may be tightened via wingnut 206 against one of adjustment rods 203 such that adjustment rods 203 are inhibited from sliding through apertures 202.

Adjustment block 23 further includes threaded aperture 207 positioned on front face 23*c* of adjustment block 23 and extending therethrough. Threaded aperture 207 is aligned with at least a portion of face 21*a* of mounting bracket 21. Bolt 208 including wingnut 209 is accepted by threaded aperture 207. Shaft 210 of bolt 208 is provided of a suitable length such that the distal end of shaft 210 abuts at least a portion of face 21*a* of mounting bracket 21 when the bolt is translated through threaded aperture 207. In some embodiments, bolt 208 may be tightened via wingnut 209 against mounting bracket 21 such that adjustment block 23 and adjustment plate 24 are inhibited from sliding along slot 26.

Although bow sight device 100 as depicted in FIGS. 1-3 includes the elements described above in order to adjust the vertical and horizontal position of the fluid conduit assembly with respect to the archery bow (i.e., elevation and windage adjustment means), any known means of facilitating such adjustments may be used. For example, a bow sight device may include one or more rollers and/or rails to facilitate horizontal and/or vertical adjustment of the fluid conduit assembly with respect to the archery bow.

Body 2 also includes support structure 27 coupled to support bracket 22 via mechanical fastener 28. According to the depicted embodiment, support structure 27 is circular. A support structure, however, may be of any size or shape. Support structure 27 includes apertures 29 through which sight conduit 4 is disposed.

Figure 6:
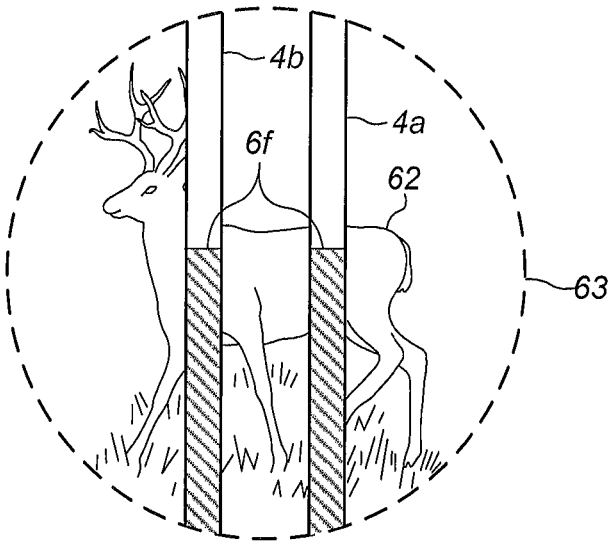
FIG. 6 depicts a sight picture formed using an embodiment of a bow sight device.

In some embodiments, a method of shooting an arrow at a target using an archery bow equipped with a bow sight device includes aiming the archery bow at the target such that, upon firing the arrow from the archery bow, the discharged arrow will hit the target. Aiming the archery bow at a target may include creating a sight picture through a peep sight attached to the bow string of an archery bow. In some embodiments, the sight picture includes one or more sight conduits and the target. For example, FIG. 6 depicts a sight picture including sight conduits 4*a* and 4*b* as well as target 62 encircled by peep sight 63. According to the depicted embodiment, target 62 is vertically aligned with visible liquid level 6*f* of the fluid conduit assembly. The target is also aligned horizontally equidistant between sight conduits 4*a* and 4*b*.

It is well known that the trajectory of an arrow fired from an archery bow is influenced by several factors. Among other things, the trajectory of an arrow may be influenced by the shooting characteristics of the archery bow and arrow respectively (e.g., bow speed, flight pattern, weight, etc.), elevation, bow angle, and wind speed. As such, it may be necessary to calibrate a bow sight device for a selected archery bow and arrow combination to ensure accurate aiming. In certain embodiments, a method a calibrating a bow sight device includes aiming the archery bow at a target from a selected elevation, and firing one or more arrows at the target. Aiming an archery bow may include creating a sight picture through a peep sight in which the target is vertically aligned with the visible liquid level of a fluid conduit assembly, the fluid conduit assembly being located at an initial position on the shaft of the archery bow. If the arrows hit the target, then the bow sight device may be properly calibrated for the selected archery bow and arrow combination. If the arrow does not hit the target, calibrating a bow sight device may include adjusting the vertical and/or horizontal position of the fluid conduit assembly with respect to the archery bow (i.e., elevation and windage adjustments). More specifically, calibrating the bow sight device may include displacing the fluid conduit assembly to a subsequent position on the shaft of the archery bow in the same direction that the arrow missed the target. For example, if the arrow hits above the target, the bow sight device may be calibrated by displacing the fluid conduit assembly upward with respect to the archery bow. The position of the fluid conduit assembly may be adjusted based on the previous firing of arrows until the arrows hit the target when fired from the bow. In some embodiments, calibrating the bow sight device at one distance is sufficient to ensure accurate aiming at a plurality of distances for the selected elevation.

In some embodiments, a method of manufacturing an archery bow includes providing the archery bow with a bow sight device.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. Terms relating to orientation, such as "upper", "lower", "top", "bottom", "left", or "right", are used for reference only; the device herein may be used in any orientation.

What is claimed is:

1. A sight device for aiming an archery bow comprising:

a body, wherein the body comprises a mounting system configured to couple the sight device to the archery bow, wherein the body is mountable to at least a portion of the archery bow; and a fluid conduit assembly, coupled to the body, containing a liquid and comprising:

at least one supply conduit;

a first sight conduit and a second sight conduit in fluid communication with at least one supply conduit, wherein the first and second sight conduits are configured such that when the bow is canted to the right, the amount of the liquid in the first sight conduit is greater than the amount of the liquid in the second sight conduit, and when the bow is canted to the left, the amount of the liquid in the second sight conduit is greater than the amount of the liquid in the first sight conduit;

at least one sight conduit in fluid communication with at least one supply conduit, wherein the sight conduit is positioned such that, when the sight device is coupled to the archery bow, and the archery bow is held at a substantially level position, the liquid is at a first level in the fluid conduit assembly;

wherein at least one supply conduit is positioned with respect to at least one sight conduit such that, when the body is angled downward from the substantially level position, liquid flows from the supply conduit to the sight conduit, and when the body is angled upward from the substantially level position, liquid flows from the sight conduit to the supply conduit; and wherein the level of the liquid in at least a portion of the fluid conduit assembly provides a sight indication for the archery bow.

2. The sight device of claim 1, wherein the fluid conduit assembly is configured such that the effect of gravity on the level of the liquid in at least a portion of the fluid conduit assembly is proportional to the effect of gravity on the trajectory of an arrow shot from an archery bow for a range of bow angles.

3. The sight device of claim 1, wherein at least one supply conduit is arranged at an oblique angle with respect to a longitudinal axis of at least one sight conduit such that the amount of the liquid in the sight conduit is lowered by a greater amount per degree of upward angulation from the substantially level position than the amount of the liquid in the sight conduit is raised per degree of downward angulation from the substantially level position, for a range of bow angles.

4. The sight device of claim 1, wherein the aggregate area of one or more supply conduits is about 0.5 to 5 times the aggregate area of one or more sight conduits.

5. The sight device of claim 1, wherein the fluid conduit assembly contains a selected amount of the liquid, and wherein the volume of the selected amount of liquid is about 30% to 70% of the volume of the fluid conduit assembly.

6. A sight device for aiming an archery bow comprising:
a body, wherein the body comprises a mounting system configured to couple the sight device to the archery bow; and
a fluid conduit assembly, coupled to the body, containing a liquid and comprising:
at least one supply conduit;
at least two sight conduits in fluid communication with at least one of the supply conduits, wherein the fluid conduit assembly is a closed loop;
wherein at least a portion of the supply conduit is positioned at an oblique angle of about 15° to 30° with respect to a longitudinal axis of the sight conduit; and
wherein a visible level of the liquid in the sight conduit provides a sight indication for the archery bow.

7. The sight device of claim 6, wherein at least a portion of the supply conduit is positioned at an oblique angle of about 20° to 26° with respect to a longitudinal axis of the sight conduit.

8. The sight device of claim 6, wherein the body is mountable to at least a portion of the archery bow.

9. The sight device of claim 8, wherein the at least one sight conduit is positioned substantially parallel to the bow string of the archery bow when the body is coupled to the archery bow.

10. The sight device of claim 8, further comprising means for adjusting the vertical position and/or the horizontal position of the fluid conduit assembly with respect to the frame of the archery bow.

11. The sight device of claim 6, wherein the aggregate area of one or more supply conduits is about 0.5 to 5 times the aggregate area of one or more sight conduits.

12. The sight device of claim 6, wherein the liquid comprises at least one anti-freezing agent, and wherein the liquid is less viscous than water.

13. The sight device of claim 6, wherein the fluid conduit assembly is substantially symmetrical about a horizontal axis.

14. An archery bow comprising:
a bow sight device comprising:
a body; and
a fluid conduit assembly, coupled to the body, containing a liquid and comprising:
at least one supply conduit;
at least one sight conduit in fluid communication with at least one supply conduit, wherein the sight conduit is positioned such that, when the sight device is coupled to an archery bow, and the archery bow is held at a substantially level position, the liquid is at a first level in the fluid conduit assembly;
wherein at least one supply conduit is positioned with respect to at least one sight conduit such that, when the body is angled downward from the substantially level position, liquid flows from the supply conduit to the sight conduit, and when the body is angled upward from the substantially level position, liquid flows from the sight conduit to the supply conduit; and
wherein the level of the liquid in at least a portion of the fluid conduit assembly provides a sight indication for the archery bow.

15. The archery bow of claim 14, wherein the body is mountable to at least a portion of the archery bow.

16. The archery bow of claim 15, comprising a first sight conduit and a second sight conduit in fluid communication with at least one supply conduit, and wherein the first and second sight conduits are configured such that when the bow is canted to the right, the amount of the liquid in the first sight conduit is greater than the amount of the liquid in the second sight conduit, and when the bow is canted to the left, the amount of the liquid in the second sight conduit is greater than the amount of the liquid in the first sight conduit.

17. The archery bow of claim 14, wherein the fluid conduit assembly is configured such that the effect of gravity on the level of the liquid in at least a portion of the fluid conduit assembly is proportional to the effect of gravity on the trajectory of an arrow shot from an archery bow for a range of bow angles.

18. The archery bow of claim 14, wherein at least one supply conduit is arranged at an oblique angle with respect to a longitudinal axis of at least one sight conduit such that the amount of the liquid in the sight conduit is lowered by a greater amount per degree of upward angulation from the substantially level position than the amount of the liquid in the sight conduit is raised per degree of downward angulation from the substantially level position, for a range of bow angles.

19. The archery bow of claim 14, wherein at least a portion of the supply conduit is positioned at an oblique angle of about 15° to 30° with respect to a longitudinal axis of the sight conduit.

20. The archery bow of claim 14, wherein the aggregate area of one or more supply conduits is about 0.5 to 5 times the aggregate area of one or more sight conduits.

21. The archery bow of claim 20, wherein the fluid conduit assembly contains a selected amount of the liquid, and wherein the volume of the selected amount of liquid is about 30% to 70% of the volume of the fluid conduit assembly.

22. A method of shooting an arrow at a target using an archery bow comprising:
aiming the archery bow at the target, the archery bow comprising:
a sight device comprising:
a body; and
a fluid conduit assembly, coupled to the body, containing a liquid and comprising:
at least one supply conduit;
at least one sight conduit in fluid communication with at least one supply conduit, wherein the sight conduit is positioned such that, when the sight device is coupled to an archery bow, and the archery bow is held at a substantially level position, the liquid is at a first level in the fluid conduit assembly;
wherein at least one supply conduit is positioned with respect to at least one sight conduit such that, when the body is angled downward from the substantially level position, liquid flows from the supply conduit to the sight conduit, and when the body is angled upward from the substantially level position, liquid flows from the sight conduit to the supply conduit;
wherein the level of the liquid in at least a portion of the fluid conduit assembly provides a sight indication for the archery bow; and wherein aiming the archery bow comprises aligning the target with the visible level of the liquid in at least one sight conduit.

23. The method of claim 22, wherein the body is mountable to at least a portion of the archery bow.

24. The method of claim 23, wherein the sight device comprises a first sight conduit and a second sight conduit in fluid communication with at least one supply conduit, and wherein the first and second sight conduits are configured such that when the bow is canted to the right, the amount of the liquid in the first sight conduit is greater than the amount of the liquid in the second sight conduit, and when the bow is canted to the left, the amount of the liquid in the second sight conduit is greater than the amount of the liquid in the first sight conduit.

25. The method of claim 22, wherein the fluid conduit assembly is configured such that the effect of gravity on the level of the liquid in at least a portion of the fluid conduit assembly is proportional to the effect of gravity on the trajectory of an arrow shot from an archery bow for a range of bow angles.

26. The method of claim 22, wherein at least one supply conduit is arranged at an oblique angle with respect to a longitudinal axis of at least one sight conduit such that the amount of the liquid in the sight conduit is lowered by a greater amount per degree of upward angulation from the substantially level position than the amount of the liquid in the sight conduit is raised per degree of downward angulation from the substantially level position, for a range of bow angles.

27. The method of claim 22, wherein at least a portion of the supply conduit is positioned at an oblique angle of about 15° to 30° with respect to a longitudinal axis of the sight conduit.

28. The method of claim 22, wherein the aggregate area of one or more supply conduits is about 0.5 to 5 times the aggregate area of one or more sight conduits.

29. The method of claim 28, wherein the fluid conduit assembly contains a selected amount of the liquid, and wherein the volume of the selected amount of liquid is about 30% to 70% of the volume of the fluid conduit assembly.

30. A method of manufacturing an archery bow comprising:

providing the archery bow with a sight device comprising:

a body; and a fluid conduit assembly, coupled to the body, containing a liquid and comprising:

at least one supply conduit;

at least one sight conduit in fluid communication with at least one supply conduit, wherein the sight conduit is positioned such that, when the sight device is coupled to an archery bow, and the archery bow is held at a substantially level position, the liquid is at a first level in the fluid conduit assembly;

wherein at least one supply conduit is positioned with respect to at least one sight conduit such that, when the body is angled downward from the substantially level position, liquid flows from the supply conduit to the sight conduit, and when the body is angled upward from the substantially level position, liquid flows from the sight conduit to the supply conduit; and wherein the level of the liquid in at least a portion of the fluid conduit assembly provides a sight indication for the archery bow.

31. The method of claim 30, further including mounting the body to at least a portion of the archery bow.

32. The method of claim 31, wherein the sight device comprises a first sight conduit and a second sight conduit in fluid communication with at least one supply conduit, and wherein the first and second sight conduits are configured such that when the bow is canted to the right, the amount of the liquid in the first sight conduit is greater than the amount of the liquid in the second sight conduit, and when the bow is canted to the left, the amount of the liquid in the second sight conduit is greater than the amount of the liquid in the first sight conduit.

33. The method of claim 30, wherein the fluid conduit assembly is configured such that the effect of gravity on the level of the liquid in at least a portion of the fluid conduit assembly is proportional to the effect of gravity on the trajectory of an arrow shot from an archery bow for a range of bow angles.

34. The method of claim 30, wherein at least one supply conduit is arranged at an oblique angle with respect to a longitudinal axis of at least one sight conduit such that the amount of the liquid in the sight conduit is lowered by a greater amount per degree of upward angulation from the substantially level position than the amount of the liquid in the sight conduit is raised per degree of downward angulation from the substantially level position, for a range of bow angles.

35. The method of claim 30, wherein at least a portion of the supply conduit is positioned at an oblique angle of about 15° to 30° with respect to a longitudinal axis of the sight conduit.

36. The method of claim 30, wherein the aggregate area of one or more supply conduits is about 0.5 to 5 times the aggregate area of one or more sight conduits.

37. The method of claim 30, wherein the fluid conduit assembly contains a selected amount of the liquid.

38. The method of claim 37, wherein the fluid conduit assembly contains a selected amount of the liquid, and wherein the volume of the selected amount of liquid is about 30% to 70% of the volume of the fluid conduit assembly.

39. A sight device for aiming an archery bow comprising:

a body, wherein the body comprises a mounting system configured to couple the sight device to the archery bow, and wherein the body is mountable to at least a portion of the archery bow; and a fluid conduit assembly, coupled to the body, containing a liquid and comprising:

at least one supply conduit;

at least one sight conduit in fluid communication with the supply conduit;

wherein at least a portion of the supply conduit is positioned at an oblique angle of about 15° to 30° with respect to a longitudinal axis of the sight conduit wherein the vertical position and/or the horizontal position of the fluid conduit assembly is adjustable, during use, with respect to the frame of the archery bow; and wherein a visible level of the liquid in the sight conduit provides a sight indication for the archery bow.

40. The sight device of claim 39, wherein at least a portion of the supply conduit is positioned at an oblique angle of about 20° to 26° with respect to a longitudinal axis of the sight conduit.

41. The sight device of claim 39, wherein the at least one sight conduit is positioned substantially parallel to the bow string of the archery bow when the body is coupled to the archery bow.

42. The sight device of claim 39, wherein the fluid conduit assembly includes two sight conduits in fluid communication with at least one supply conduit, and wherein the fluid conduit assembly is a closed loop.

43. The sight device of claim 39, wherein the aggregate area of one or more supply conduits is about 0.5 to 5 times the aggregate area of one or more sight conduits.

44. The sight device of claim 39, wherein the liquid comprises at least one anti-freezing agent, and wherein the liquid is less viscous than water.

45. The sight device of claim 39, wherein the fluid conduit assembly is substantially symmetrical about a horizontal axis.

* * * * *